United States Patent [19]

Powell

[11] 4,391,429

[45] Jul. 5, 1983

[54] FORM TIE

[76] Inventor: John M. Powell, P.O. Box 3200, San Jose, Calif. 95156

[21] Appl. No.: 299,799

[22] Filed: Sep. 4, 1981

[51] Int. Cl.[3] ..... E04G 17/08

[52] U.S. Cl. ..... 249/84; 249/91; 249/190; 249/216

[58] Field of Search ..... 249/40, 42, 43, 46, 249/84, 91, 190, 216

[56] References Cited

U.S. PATENT DOCUMENTS

| | | | |
|---|---|---|---|
| 1,097,796 | 5/1914 | Fueher | 249/20 |
| 1,564,981 | 12/1925 | Smith | 249/216 |
| 1,729,807 | 10/1929 | Toogood | 249/216 |
| 1,924,631 | 8/1933 | Toogood | 249/216 |
| 3,199,827 | 8/1965 | Terry | 249/216 |
| 3,263,956 | 8/1966 | Hawkins | 249/216 |
| 4,034,950 | 7/1977 | Powell | 249/216 |

*Primary Examiner*—John A. Parrish
*Attorney, Agent, or Firm*—Robert W. Dilts

[57] ABSTRACT

A form tie is disclosed for interconnecting a pair of spaced panels providing the sides of a form and for locating and supporting at least one reinforcing rod at a preselected location intermediate the panels. The form tie includes a unitary elongated member of generally Z-shaped configuration having generally parallel elongate members joined by an intermediate diagonal member and rectilinear braces and tabs for supporting the panels of the form. One embodiment of the present invention includes a second elongate member formed integrally with the generally Z-shaped member for locating and supporting a reinforcing rod at a preselected location intermediate the panels. Alternate embodiments of the form tie of the present invention include means for locating and supporting a second reinforcing rod at a preselected location intermediate the panels. The specific structural features of the form tie also provide improved resistance to vertical and horizontal shear forces acting on the form sides in addition to resisting transverse forces which tend to move the form sides toward or away from each other.

3 Claims, 7 Drawing Figures

FORM TIE

BACKGROUND OF THE INVENTION

This invention relates to forms for concrete and the like and more particularly to an improved unitary article of manufacture for use in assembling such forms in the field.

In constructing walls, foundations, curbs and the like of concrete or similar initially fluid materials which subsequently harden into the desired structure, it is common to fabricate a form consisting of spaced sides or panels defining the exterior side surfaces of the desired structure. It has been proposed in the prior art to provide elongated metal members or form ties adapted to extend between the side panels of a form and temporarily tie the sides or panels of the form to each other while concrete for example is poured into the form and allowed to harden. Such form ties are thus imbedded in the concrete and means are provided for the subsequent release of the form sides from the form ties so that the form sides or panels may be removed for reuse.

U.S. Pat. No. 1,097,796 (Fuehrer) and U.S. Pat. No. 1,729,807 (Toogood) are representative of prior art form ties. However, the form tie disclosed by Fuehrer will not resist either shear forces or transverse forces acting on the form sides unless used in pairs at given locations to form an X-shaped configuration. The form tie disclosed by Toogood will resist transverse forces acting on the form sides when used alone at a given location but will not resist shear forces even if more than one is used at a given location.

U.S. Pat. No. 3,199,827 (Terry) discloses a preassembled, multielement form tie which includes a pair of elements or cross members similar to the form tie described by Toogood interconnected by additional elements being vertical stringer members and diagonal members adapted to resist vertical shear forces. A limitation of such a form tie is the relatively complicated form structure requiring spot welding of the vertical stringer members and the diagonal members to the upper and lower cross members. Furthermore, such a form tie is required to be set in a concrete footing before the panels are attached thereto for forming a stemwall disposed upon the footing. The panels include openings for receiving portions of the form ties therethrough to secure the panels to the form tie. A further limitation of a form tie which is set in the footing is that a precise location of the form tie is required for alignment to the openings in the panels or the openings must be large enough to compensate for any error in the placement of the form ties. Such a compensation will reduce the resistance to horizontal shear forces.

U.S. Pat. No. 4,034,950 (Powell) shows a form tie which is particularly useful when used in a plurality of vertical and horizontal rows in interconnecting the form sides. The positions of all of the form ties may be varied with respect to each other to provide resistance to shear and transverse forces. However, in certain applications, for example, the construction of basement and retaining walls and supporting columns for bridges, roadways and the like, long forms are used, and it is frequently necessary to secure reinforcing steel or rods intermediate the form sides at certain predetermined depths and lateral locations relative to the side panels to attain the desired strength within the concrete structure. A further limitation, therefore, of the prior art form ties is that while reinforcing steel may be supported thereon, the force exerted by the concrete as it is poured into the form may shift the lateral location of the rods, thus weakening the structure.

The foregoing illustrates the limitations of the known prior art. Thus, it is apparent that it would be advantageous to provide an alternative to the prior art.

SUMMARY OF THE INVENTION

According to the present invention, a pair of form sides are fixed in a preselected spaced position with respect to each other against shear and transverse forces acting thereon at a given location by means of a form tie comprising a unitary elongate member of generally Z-shaped configuration. In one aspect of the present invention, the form tie has generally parallel elongate members joined by an intermediate diagonal member, one end of each parallel elongate member having a bight therein terminating in a rectilinear brace extending substantially normal to the parallel elongate members. The other end of each parallel elongate member has a bight formed therein terminating in a rectilinear tab extending substantially normal to the parallel elongate members. The form tie further includes means for locating and supporting at least one reinforcing bar at a preselected position intermediate the form sides.

BRIEF DESCRIPTION OF THE DRAWINGS

The foregoing and other objects and features of the subject invention will be more fully understood from a reading of the following detailed description of preferred embodiments thereof in conjunction with the attached drawings wherein.

DESCRIPTION OF THE PREFERRED EMBODIMENTS

Figure 3:
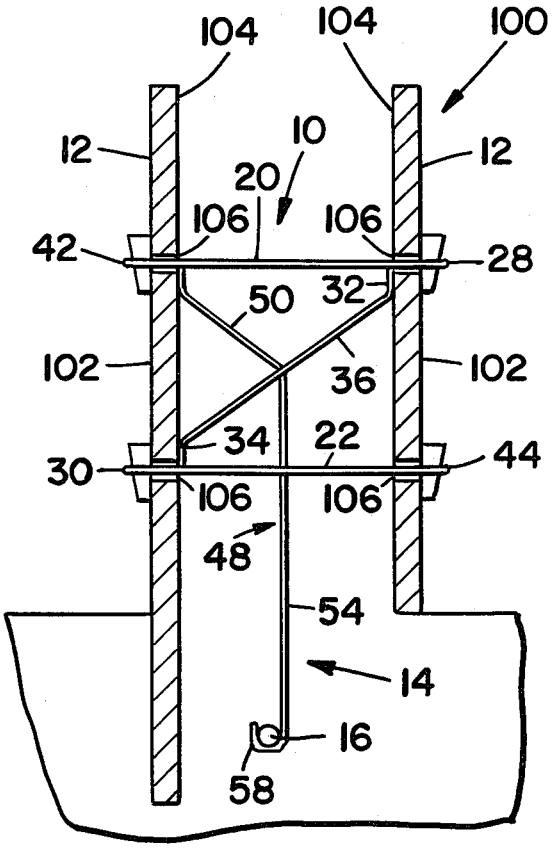
FIG. 3 is a side elevational view of the form tie of FIG. 1 illustrating a pair of panels in cross section interconnected to the form tie.

Referring now to the drawings, there is shown a form tie 10 constructed in accordance with the teachings of the present invention. The form tie is of a simple, unitary, prefabricated, elongate construction for fixing a pair of form sides or panels 12 in a preselected spaced position with respect to each other at a given location against both transverse forces and shear forces acting on the panels at the location of the tie, which approaches the maximum for the amount of material used in the form tie. As best shown in FIG. 3, the form tie also includes means 14 for locating and supporting a reinforcing rod 16 at a preselected location intermediate the form sides.

Figure 1:
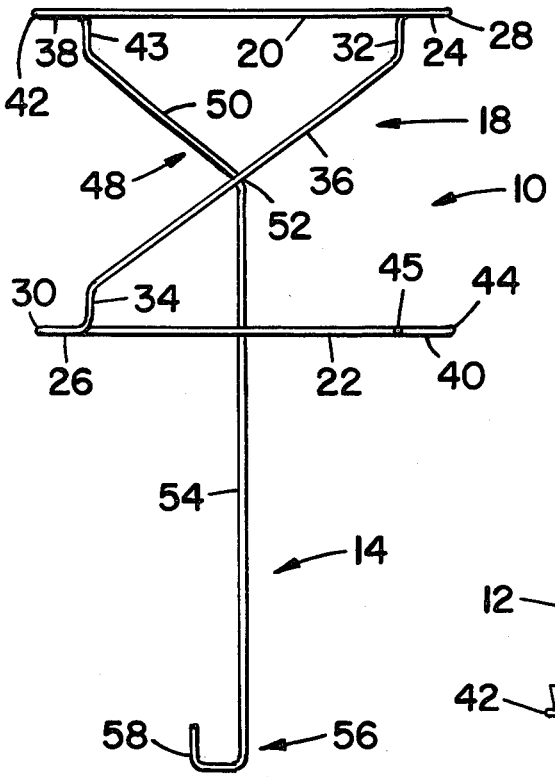
FIG. 1 is a side elevational view of a form tie constructed in accordance with the present invention.
Figure 2:
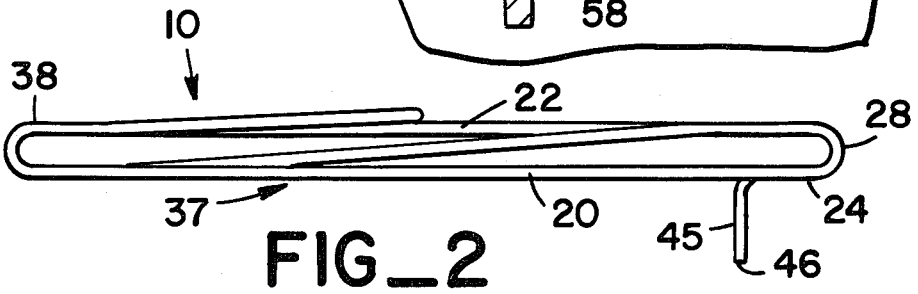
FIG. 2 is an enlarged top plan view of the form tie of FIG. 1.

Referring now to FIGS. 1 and 2, a form tie 10 according to the present invention is illustrated in greater detail. The form tie includes a unitary elongate member 18 of a generally Z-shaped configuration including a pair of vertically spaced generally parallel elongate members or ends 20, 22, each having one end portion 24, 26 having a bight 28, 30 formed therein respectively of a depth which is greater than the thickness of each of the panels 12. Each of the bights terminates in a rectilinear brace 32, 34 respectively which extends substantially normal to the parallel elongate members, the braces being joined by an intermediate diagonal member 36. As best illustrated in FIG. 2, the parallel elongate members, the rectilinear braces and the intermediate diagonal member define a generally planar structure 37 and the bights 28, 30 lie in a plane which is substantially perpendicular thereto.

Referring again to FIG. 1, the end portions 24, 26 of each parallel elongate member are positioned in an opposed, spaced apart relationship with an opposite end portion 38, 40 of the other parallel elongate member, each of the other end portions 38, 40 having a bight 42, 44 formed therein respectively of a depth which also is greater than the thickness of each of the panels 12 and lying in a plane which is substantially perpendicular to the planar structure. Each of the bights terminates in a respective rectilinear tab 43, 45 which extends substantially normal to the parallel elongate members. The tab 45 of the lower of the vertically spaced parallel elongate members 22 lies substantially in a plane which is perpendicular to the planar structure and terminates in a free end 46. The tab 43 of the vertically upper parallel elongate member 20 lies substantially in the plane of the planar structure and is coupled to the reinforcing rod locating and supporting means 14.

As best illustrated in FIGS. 1 and 3, the locating and supporting means 14 comprises a unitary elongate member 48 formed integrally with the tab 43 and lying substantially in the plane of the generally planar structure 37. The unitary elongate member 48 includes a first portion 50 which extends obliquely from the tab 42 to a position 52 between the parallel elongate ends 20, 22 immediately adjacent the intermediate diagonal member 36 and a second portion 54 having a preselected length and extending from the first portion at the position immediately adjacent the diagonal member in a direction substantially parallel to the rectilinear braces 32, 34 to a preselected position 56 which is vertically lower than the parallel elongate members 20, 22. The second portion 54 of the locating and supporting means terminates in an L-shaped member 58 which is adapted to receive the reinforcing rod 16.

Referring now to FIGS. 4–7, there are shown alternate embodiment form ties 10*a*, 10*b* constructed in accordance with the present invention for locating and supporting a second reinforcing rod. In the above referenced drawings, for purposes of clarity, like reference numerals are used to indicate elements which are common to all embodiments of the present invention disclosed herein.

Figure 4:
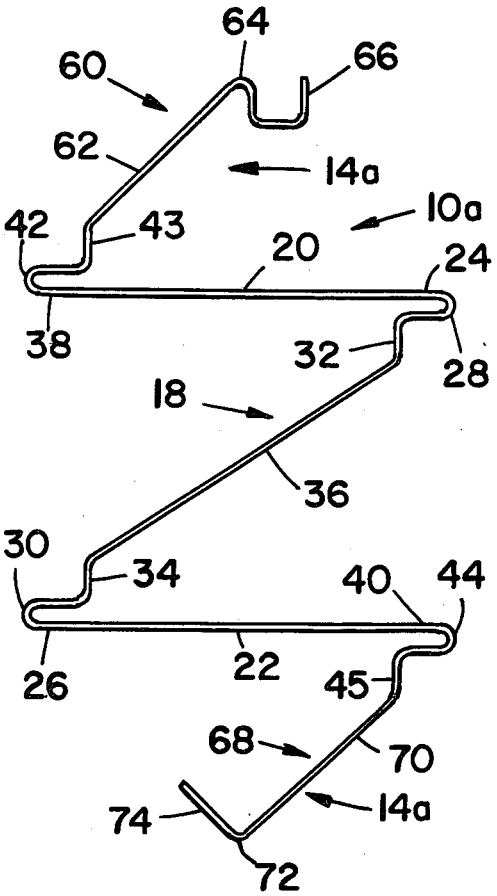
FIG. 4 is a side elevational view of an alternate embodiment form tie constructed in accordance with the present invention.
Figure 5:
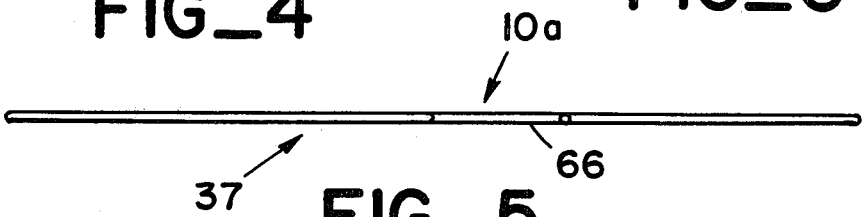
FIG. 5 is an enlarged top plan view of the form tie of FIG. 4.

Referring to the form tie 10*a* of FIGS. 4 and 5, the bights 28, 30, 42 and 44 formed in the respective end portions 24, 26, 38 and 40 of the parallel elongate members or ends 20, 22 of the unitary elongate member 18 and the rectilinear tabs 43, 45 all lie substantially in the plane of the generally planar structure 37 hereinbefore described.

The reinforcing rod locating and supporting means 14*a* comprises a unitary elongate member 60 formed integrally with the tab 43 and lying substantially in the same plane of the planar structure. The unitary elongate member 60 includes an elongate first portion 62 extending obliquely upwardly from the tab 42 in a direction substantially parallel to the intermediate diagonal member 36 and a bight 64 extending convexly outwardly from the planar structure and terminating in a U-shaped member 66 for receiving a reinforcing rod (not shown).

The locating and supporting means 14*a* further includes a second unitary elongate member 68 formed integrally with the free end 46 of the tab 45 and lying substantially in the same plane of the generally planar structure. The second unitary elongate member 68 includes a first elongate portion 70 extending obliquely downwardly from the free end 46 in a direction substantially parallel to the intermediate diagonal member 36 and a bight 72 extending convexly outwardly from the planar structure and terminating in a second elongate portion 74 disposed substantially normal to the first elongate portion. As can be seen from FIG. 4, the first elongate portion, the bight, and the second elongate portion define a generally L-shaped member which is adapted to receive a second reinforcing rod (not shown).

Figure 6:
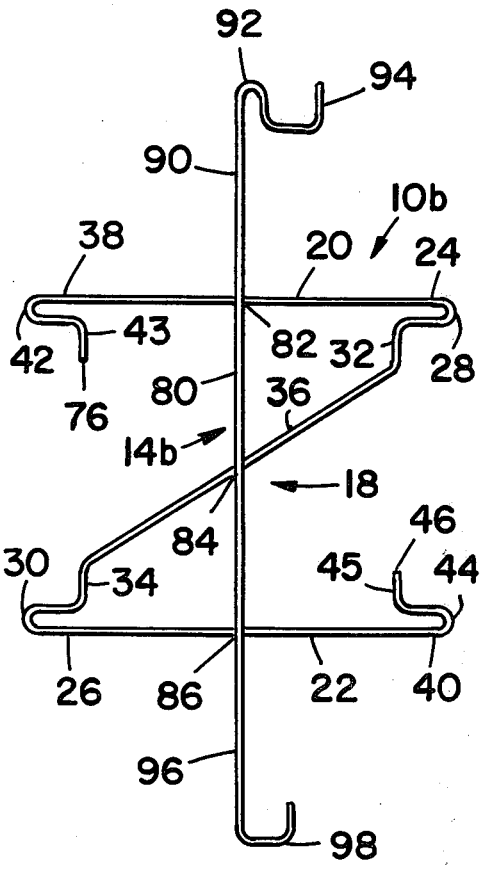
FIG. 6 is a side elevational view of a further embodiment of the form tie of the present invention.
Figure 7:
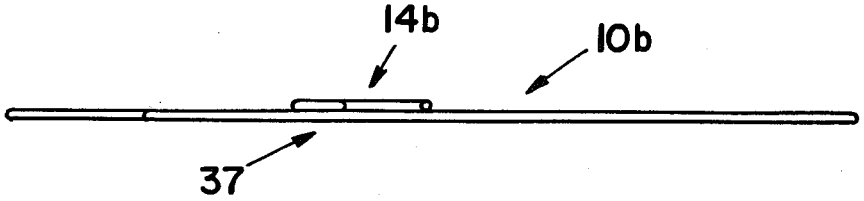
FIG. 7 is an enlarged top plan view of the form tie of FIG. 6.

Referring now to FIGS. 6 and 7, the form tie 10*b* is of the unitary construction having a generally Z-shaped configuration as hereinbefore described with respect to the embodiments of FIGS. 1 and 4. In the embodiment of FIGS. 6 and 7, the bights 28, 30, 42 and 44 and the rectilinear tabs 43 and 45 all lie substantially in the above defined plane of the generally planar structure 37; however, both the tabs 43 and 45 terminate in a free end 76 and 46 respectively.

The reinforcing rod locating and supporting means 14*b* comprises a unitary elongate member 80 lying substantially in the plane of the planar structure and extending in a direction substantially parallel to the rectilinear tabs. The elongate member 80 is positioned intermediate the end portions 24, 26 and 38, 40 of the generally parallel elongate members 20 and 22 and is coupled to the form tie 10*b*, for example by spot welding, at the points of contact 82, 84 and 86 with the generally planar structure.

The elongate member 80 includes one end portion 90 extending outwardly from the vertically upper parallel elongate member 20. The end portion has a bight 92 extending convexly outwardly from the planar structure which terminates in a U-shaped member 94 for receiving a reinforcing rod (not shown). A second end portion 96 of the elongate member extends outwardly from the vertically lower parallel elongate member 22 and terminates in an L-shaped member 98 for receiving a second reinforcing rod (not shown).

Referring now to FIG. 3, a preassembled form 100 for pouring concrete is illustrated with the form sides or panels 12 shown interconnected, by way of example, by the form tie embodiment 10 of FIGS. 1 and 2. Each panel 12 includes an exterior side 102, an interior side 104, and a plurality of openings or holes 106 extending therethrough and arranged in a linear spaced array which may be aligned with the spaced array of holes in the other panel to receive therethrough the bights of the form tie 10.

The form 100 may be preassembled by placing each of the form sides or panels 12 in a preselected spaced position with respect to one another at a desired pouring location with the holes 106 in each of the panels aligned with one of the spaced array of holes in the other of the panels. Each opening receives a respective one of the bights 28, 30, 42 and 44 therethrough, the depth of each bight necessarily being greater than the thickness of the panels. A wedge 108 is positioned within each bight abutting against the exterior side 102 of its associated panel, which draws each of the rectilinear braces and tabs 32, 34, 43 and 45 into contact with the interior side 104 of its associated panel, whereby each of the form ties in the preassembled form resist shear and transverse forces acting on the panels. A reinforcing rod 16 is then placed in the L-shaped member 58 which locates and secures the reinforcing rod intermediate the form sides. After the concrete or the like has been poured and hardened, the form ties and the reinforcing rod will be embedded therein, but the panels may be removed for reuse by removing the wedges to free the panels from the form ties.

Other aspects, objects and advantages of this invention can be obtained from the study of the drawings, the disclosure and the appended claims.

I claim:

1. A form tie for use in fixing a pair of form sides in a preselected spaced position with respect to each other at a given location against shear and transverse forces acting on said form sides at said given location and for locating, supporting and maintaining at least one reinforcing rod at a preselected location intermediate said form sides, said form tie comprising:

a unitary elongate member of a generally Z-shaped configuration including a pair of generally parallel elongate members having first and second end portions, the first end portion of each parallel, elongate member being positioned in an opposed, spaced apart relationship with respect to the second end portion of the other parallel elongate member and having a bight formed therein terminating in a rectilinear brace extending substantially normal to said parallel, elongate members, and means for locating, supporting and maintaining at least one reinforcing rod at said preselected location intermediate said form sides comprising a second unitary elongate member formed integrally with said rectilinear tab of said bight of one of said second end portions and lying substantially in the plane of said generally planar structure, said second unitary elongate member having a first portion extending obliquely from said rectilinear tab to said preselected location and terminating in an L-shaped member adapted to receive said at least one reinforcing rod and maintain said rod at said preselected location.

2. The form tie of claim 1 wherein said second unitary elongate member formed integrally with said rectilinear tab of said bight of one of said second end portions and lying substantially in the plane of said generally planar structure includes a first portion extending obliquely from said rectilinear tab to a preselected position immediately adjacent said intermediate diagonal member and a second portion extending from said first portion at said preselected position immediately adjacent said intermediate diagonal member in a direction substantially parallel to said rectilinear braces, said second portion being of a preselected length and terminating in said L-shaped member adapted to receive said at least one reinforcing rod.

3. The form tie of claim 1 wherein said second unitary elongate member formed integrally with said rectilinear tab of said bight of one of said second end portions and lying substantially in the plane of said generally planar structure includes a first elongate portion extending obliquely from said rectilinear tab in a direction substantially parallel to said intermediate diagonal member outwardly from said planar structure and terminating in an L-shaped member adapted to receive said at least one reinforcing rod at said preselected location, and a third unitary elongate member is provided formed integrally with said rectilinear tab of said bight of a different one of said second end portions and lying substantially in the plane of said generally planar structure, said third unitary elongate member having an elongate portion extending obliquely form said rectilinear tab in a direction substantially parallel to said intermediate diagonal member outwardly from said planar structure and terminating in a generally U shaped member opening outwardly from said planar structure adapted to receive a second reinforcing rod at a second preselected location intermediate said form sides.

* * * * *